United States Patent [19]

Gerr

[11] Patent Number: 4,506,620

[45] Date of Patent: Mar. 26, 1985

[54] SAILBOAT HAVING CONVERTIBLE RIG

[75] Inventor: Stanley Gerr, East Haddam, Conn.

[73] Assignee: Mark T. Huxley, New York, N.Y. ; a part interest

[21] Appl. No.: 391,228

[22] Filed: Jun. 23, 1982

[51] Int. Cl.[3] ..... B63H 9/10

[52] U.S. Cl. ..... 114/102; 114/39; 114/104

[58] Field of Search ..... 114/89, 95, 96, 97, 114/98, 102, 103, 104, 39

[56] References Cited

U.S. PATENT DOCUMENTS

| | | | |
|---|---|---|---|
| 266,065 | 10/1882 | Tudor | 114/98 |
| 559,718 | 5/1896 | King | 114/97 |
| 685,943 | 11/1901 | Pool | 114/98 |
| 1,504,057 | 8/1924 | Koelkebeck | 114/103 |
| 3,142,282 | 7/1964 | Nichols | 114/39 |
| 3,802,371 | 4/1974 | Jastrab | 114/102 |

FOREIGN PATENT DOCUMENTS

| | | | |
|---|---|---|---|
| 345845 | 11/1920 | Fed. Rep. of Germany | 114/103 |
| 84295 | 5/1982 | Japan | 114/39 |

*Primary Examiner*—Trygve M. Blix
*Assistant Examiner*—Thomas J. Brahan
*Attorney, Agent, or Firm*—Sixbey, Friedman & Leedom

[57] ABSTRACT

A sailboat comprising at least one mast, first and second pairs of primary half yards pivotally mounted on and vertically spaced apart along the mast for pivoting about the mast between first and second positions wherein the members of each pair extend from the same axial location along the mast to define 180° and 0° angles therebetween, respectively, and means for mounting a sail between the vertically spaced apart members of each pair of primary half yards, whereby the sailboat is convertible between square-rigged when the primary half yards are in the first position and fore-and-aft rigged when the primary half yards are in the second position. The sail mounting means may include a secondary half yard pivotally mounted on each primary half yard for pivoting about an axis parallel to the mast, the secondary half yards on the first and second pairs of primary half yards being opposed and vertically spaced for mounting a sail therebetween, the sail mounting secondary half yards being pivotable between a basic position wherein they extend coextensively with the primary half yards on which they are mounted and an angle position wherein the sail mounting secondary half yards form an angle greater than 0° and less than 180° with the primary half yards on which they are mounted, whereby the sailboat is convertible between square rigged when the secondary half yards are in the basic and the primary half yards are in the first position and fore-and-aft rigged when either the secondary half yards are in the basic and the primary half yards are in the second position or the secondary half yards are in the angle and the primary half yards are in the first position.

10 Claims, 13 Drawing Figures

SAILBOAT HAVING CONVERTIBLE RIG

DESCRIPTION

1. Technical Field

The present invention relates to sailboats and, more particularly, to sailboats carrying sails which are convertible between square-rigged and fore-and-aft rigged.

2. Background Art

Towards the end of the last century, sailing ships still carried a significant portion of the world's trans-ocean cargoes. Over the years sailing ships were replaced by steam and diesel motor ships which used low-cost fossil fuels. The economic advantage, in terms of time saved and predictable scheduling vs. fuel cost, of fossil fueled ships over wind driven ships continued without question until recently when, with the tremendous increase in the cost of crude oil, the cost of fuel for powering commercial ships has increased many times. Indeed, in a world where petroleum-based energy is becoming increasingly expensive, many believe that a move toward restoring sail freight as a viable industry is becoming economically attractive. In this context, even a partial switch of the world's commercial fleet back to sail power would be economically beneficial and the widespread use of wind power, a non-polluting and ever-regenerating energy source, would have the added benefit of being environmentally and energywise attractive.

Square rigged vessels have traditionally been the vessels of choice for wind-driven ocean going commerce. It is well known that the square rig, with only a very limited ability to sail to windward, provides, nevertheless, the most effective sail plan for exploiting a fair wind and, since long commercial voyages under sail have almost always been made by running down one or another of the prevailing wind systems (e.g., the Trades, Westerlies, etc.,) as long as possible, for such voyages the square rig is basic. At the same time some experts believe that the fore-and-aft rig, relatively inefficient in a fair wind, but universally acknowledged as the best sail plan for coastal and other sailing which requires much working to windward (i.e., against a foul wind), would also be preferable in modern day ocean going vessels because it is easier to handle, requires less crew and is readily adaptable to automation. However, nothwithstanding the advantages and disadvantages of each type of rig, it is clear that since the wind will never be constantly fair or foul for any lengthy voyage, vessels provided with one or the other of the two basic rigs must, of necessity, be alternately favored or hindered during a long voyage, depending upon the different courses sailed and the wind directions encountered.

Attempts to remedy or improve this situation have in the past led to a variety of compromise rigs which, it was hoped, would combine the best features of both major types of rig, as in topsail schooners, brigantines, barks, barkentines, as well as other unusual combinations in which multimasted vessels had two or more masts square rigged and two or more masts fore-and-aft rigged, or had the same mast carrying several square sails over a fore-and-aft sail, and the like. However, these compromise rigs, though a logical step in the right direction, could not provide a definitive solution to the problem of the most suitable rig for large wind-driven vessels because there is an inevitable contradiction in the attempt to use both types of rig simultaneously. Under such circumstances a part of the sail-plan of these combined rigs must always function at less than maximum effectiveness, e.g., when sailing with a fair wind the fore-and-aft rigged masts, or the fore-and-aft sails, were not nearly as effective as full square rig would be, and conversely, when sailing to windward, the square rigged masts or the square sails imposed their very limited capacity for working to windward on the whole ship. The simultaneous use of both types of rig or sail thus tends to annul, or at least severely limit, the advantages of each.

Rather than attempt to use both rig types simultaneously, which is relatively inefficient and self-defeating, a modern day ocean going wind powered vessel requires a system for completely converting, quickly and flexibly, from square rigged to fore-and-aft rigged, and vice-versa, using the same suit of sails. It is, therefore, the purpose of the present invention to provide a sailboat which includes means for converting completely from one rig to the other when the wind or the course changes in order that the sails are always being used most effectively for the particular wind direction encountered—square rig for fair winds, fore-and-aft rig for head winds.

DISCLOSURE OF THE INVENTION

In one aspect of the present invention this is accomplished by providing a sailboat having at least one mast, first and second pairs of primary half yards pivotally mounted on and vertically spaced apart along the mast for pivoting substantially about the axis of the mast between a first position wherein the members of each pair of primary half yards extend in opposite directions from the same axial location along the mast to define a 180° angle therebetween, and a second position wherein the members of each pair of primary half yards extend in substantially the same direction from the same axial location along the mast to define a substantially 0° angle therebetween, and means for carrying, i.e., mounting, a sail between the spaced apart members of each pair of primary half yards. The sailboat is convertible between square-rigged when the primary half yards are in the first position and fore-and-aft rigged when the primary half yards are in the second position.

In another aspect of the invention, the means for carrying a sail between the spaced apart members of each pair of primary half yards includes a secondary half yard mounted on each primary half yard for pivoting about a pivot axis extending substantially parallel to the mast, the secondary half yards mounted on the first pair of primary half yards opposing and vertically spaced from the secondary half yards mounted on the second pair of primary half yards, each pair of vertically spaced, opposed secondary half yards comprising sail mounting means for carrying a sail therebetween, the sail being pivotable with the pair of sail mounting secondary half yards between a basic position wherein the members of each pair of sail mounting secondary half yards extend substantially co-extensively with the primary half yards on which they are mounted and an angle position wherein the members of each pair of sail mounting secondary half yards are arranged at an angle of more than 0° and less than 180° to the primary half yards on which they are mounted. The sailboat is convertible between square rigged when the secondary half yards are in the basic position and the primary half yards are in the first position and fore-and-aft rigged when either the secondary half yards are in the basic position and the primary half yards are in the second position or the secondary half yards are in the angle position with the sails oriented substantially fore-and-aft and the primary half yards are in the first position.

BEST MODE FOR CARRYING OUT THE INVENTION

Figure 4A:
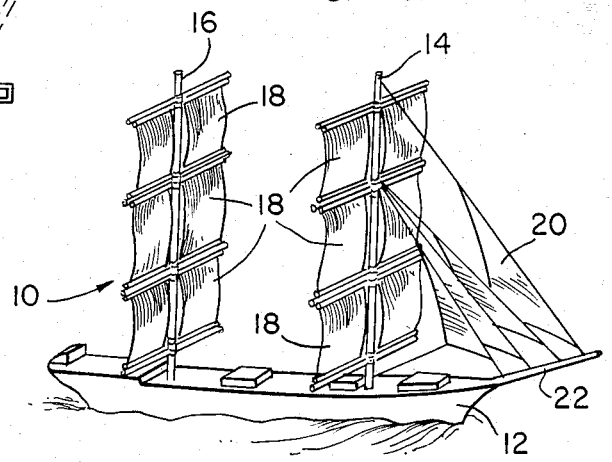
FIG. 4*a* is a perspective of a multi-masted embodiment of the sailboat of the present invention showing the sails on each mast arranged as in FIG. 1.
Figure 4B:
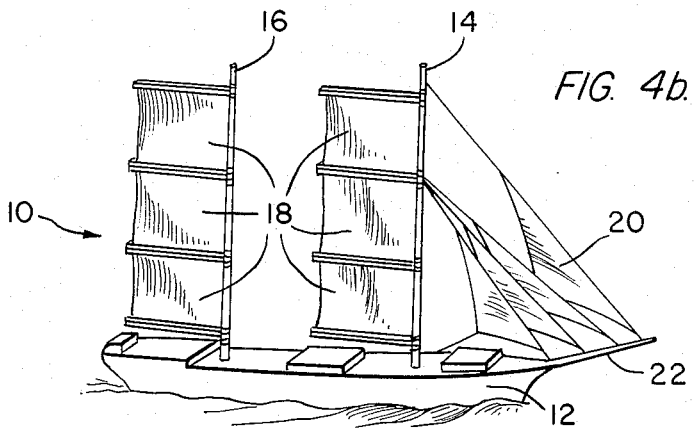
FIG. 4*b* is a perspective view of a multi-masted embodiment of the sailboat of the present invention showing the sails on each mast arranged as in FIG. 5.
Figure 4C:
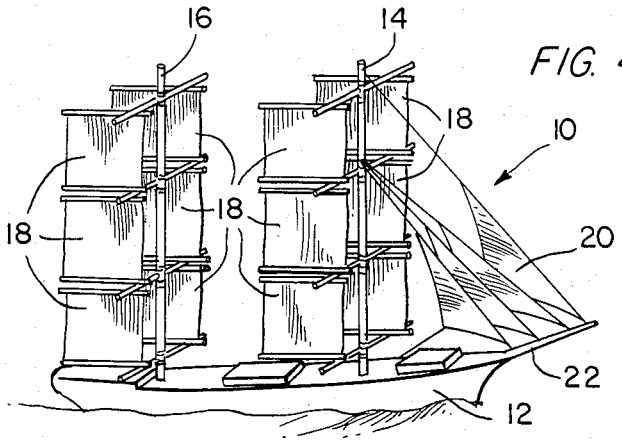
FIG. 4*c* is a perspective view of a multi-masted embodiment of the sailboat of the present invention showing the sails on each mast arranged as in FIG. 6.

Referring to the drawings and particularly to FIGS. 4*a*, 4*b* and 4*c*, the sailboat of the present invention is illustrated generally at 10. Sailboat 10, which may be of any size, from multi-masted ocean going freighter to single-masted pleasure yacht, consists of a hull 12 appropriately equipped with keel or centerboard (not shown) and including at least one mast 14, 16 suitably mounted on and supported by the hull 12 for mounting from one to a plurality of sails 18 thereon. If desired, sailboat 10 may include one or more headsails 20 carried between mast 14 and bowsprit 22. Sails 18 may be carried on yards in the basic square rig configuration illustrated in FIG. 4*a* or in one of the various fore-and-aft rig configurations illustrated in FIGS. 4*b* and 4*c*. As will become apparent from the discussion which follows, the selection of the most appropriate fore-and-aft rig configuration in any circumstance depends on wind and weather conditions.

Figure 1:
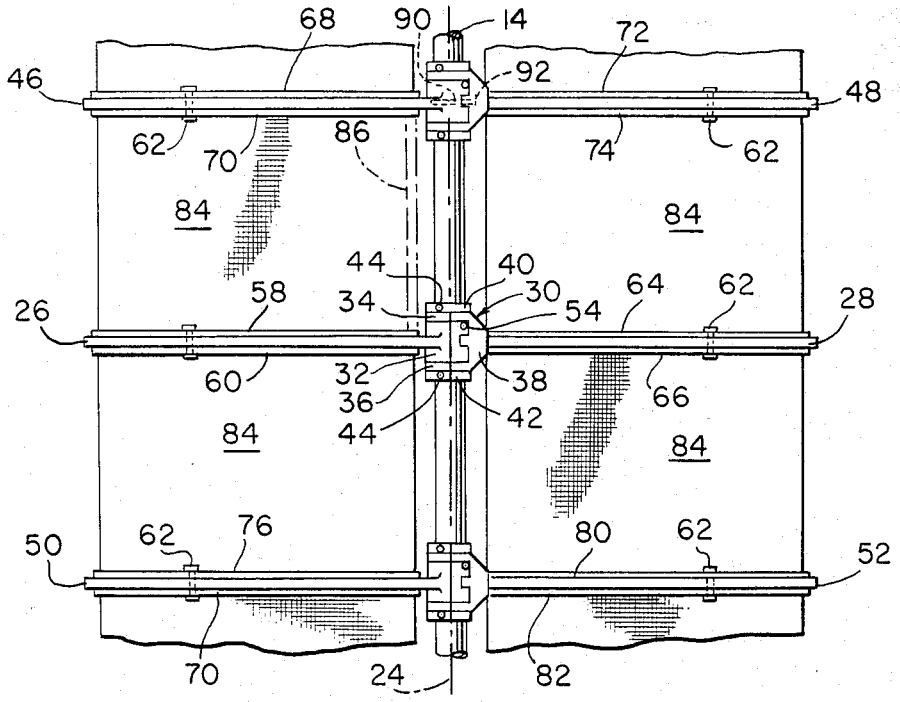
FIG. 1 is a partial perspective view of the sailboat of the present invention showing the sails arranged in a square rigged configuration.
Figure 2A:
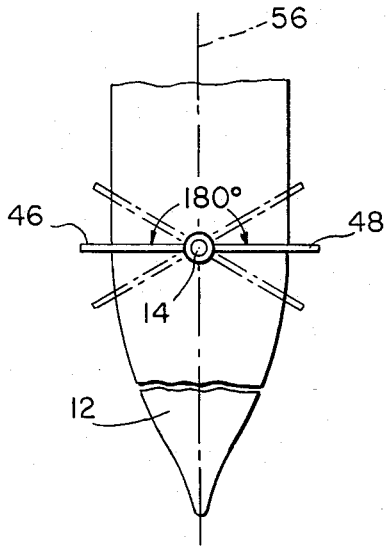
FIG. 2*a* is a partial plan view of the sailboat of the present invention showing exemplary orientations for a pair of primary half yards in the first position.
Figure 2B:
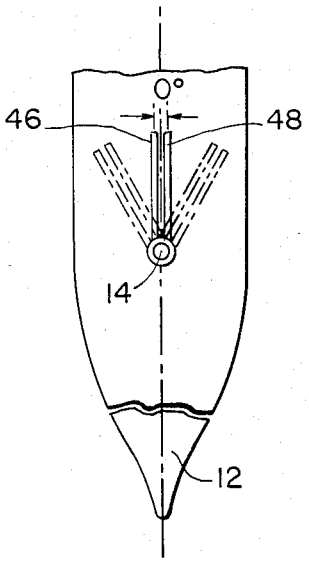
FIG. 2*b* is a partial plan view of the sailboat of the present invention showing exemplary orientations for a pair of primary half yards in the second position.

The mast and yard arrangement may readily be seen from a consideration of the basic square rig configuration illustrated in FIG. 1. The term "yard" is used herein in its conventional nautical sense to mean a rod or spar mounted at right angles across a mast to carry a sail. Pivotally mounted on mast 14 for pivotal movement substantially about the longitudinal axis 24 of mast 14 is a first yard formed as a first pair of primary half yards 26,28 which extend substantially normal to mast 14 at the same axial location therealong from a mast mounting such as split sleeve or collar pivotal mounting means 30. The term "half yards" is used herein to describe the preferred embodiment wherein the yard portions on either side of the mast are equal in length. However, the term refers broadly to the yard portions which comprise the yard and is intended to encompass not only yard portions which are equal in length but also yard portions which may be unequal in length. Mounting means 30 includes a central sleeve 32 on mast 14 for mounting primary half yard 26 and outer sleeves 34,36, on opposite ends of central sleeve 32, on mast 14 supporting web 38 for mounting primary half yard 28 thereto. Sleeves 32,34,36 are slidable on and along mast 14 and are positionable at any desired location by locking sleeves 40,42 which are movably fixed in position on opposite ends of mounting means 30, as by set screws 44 or other locking means. Vertically spaced above and below primary half yard pair 26,28, respectively, are second and third primary half yard pairs 46,48 and 50,52. The second and third primary half yard pairs are substantially the same as the first primary half yard pair and each pair is pivotally mounted to mast 14 in substantially the same manner. As can be seen most clearly in FIGS. 2*a* and 2*b*, the members of each pair of primary half yards are pivotable about mast 14 between a first position, shown in FIG. 2*a*, in which the members of each pair (46,48) of primary half yards extend in opposite directions from mast 14 to define a 180° angle therebetween, and a second position, shown in FIG. 2*b*, in which the members of each pair (46,48) of primary half yards extend in substantially the same direction from mast 14 to define a substantially 0° angle therebetween. Locking means, such as latch bar 90 adjacent the inner end of primary half yard 46 releasably engaging latch bar receiving means 92 adjacent the inner end of primary half yard 48 or other locking means, such as mechanically, hydraulically or electrically actuated latching means, may be employed to lock the primary half yards in the first or second positions. The members of each pair of primary half yards are prevented from pivoting beyond the 180° first position by engagement between a projecting stop 54 on central sleeve 32 and web 38 and, desirably, by a locking means which maintains the primary half yards in the first position unless released. The members of each pair of primary half yards are prevented from pivoting beyond the 0° second position by locking means and because, in the 0° position, they abut each other. It will be appreciated, however, that although the relative angular relationship between the members of each pair of primary half yards is limited, each pair of primary half yards is free to pivot about mast 14 to assume any desired position relative to the axis 56 of hull 12. Thus, the solid line illustration in FIG. 2*a* of the primary half yards extending essentially normal to axis 56, in the more or less conventional square rig configuration, is merely exemplary and it will be appreciated that the principal half yards in the first position may assume other exemplary angular positions relative to axis 56, as shown in phantom in FIG. 2*a*. Likewise, the solid line illustration in FIG. 2*b* of the primary half yards extending aft from mast 14 essentially parallel to and along axis 56, in the more or less conventional fore-and-aft configuration, is merely exemplary of the various angular positions relative to axis 56 which the principal half yards in the second position may assume, as shown in phantom in FIG. 2*b*.

Figure 3:
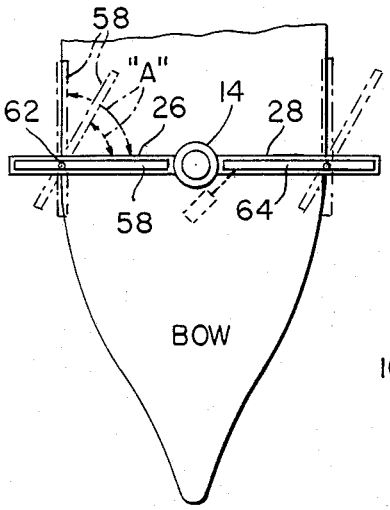
FIG. 3 is a partial plan view of the sailboat of the present invention showing exemplary orientations for secondary half yards with respect to the primary half yards on which they are pivotally mounted.

Secondary yards 58,60 are mounted immediately above and below primary half yard 26 and are pivotally affixed thereto via pivot pin 62 which passes through apertures in upper secondary half yard 58, primary half yard 26 and lower secondary half yard 60 at a point along the length of primary half yard 26 located between about its middle and the end thereof remote from mast 14. Most desirably, pivot pin 62 is located at a point about two-thirds of the distance along the primary half yard 26 from mast 14. This arrangement of primary and secondary half yards allows each of the secondary half yards 58,60 to pivot independently and freely about pivot pin 62 from a basic or nominal position in which each of the secondary half yards is coextensive over its entire length with primary half yard 26 to an angle position in which the secondary half yards 58,60 form an angle greater than 0° and less than 180° with primary half yard 26. FIG. 3 illustrates, in solid lines, the basic position in which secondary half yard 58 overlies and is coextensive with primary half yard 26. Secondary half yard 58 is pivotable about pivot pin 62 to form an angle "A" with primary half yard 26 which is greater than 0° but less than 180°, as shown in phantom in FIG. 3. Hydraulic means such as a cylinder mounted on the mast and a piston slidable therein having its free end connected to the secondary half yard, may be employed for moving the secondary half yard between its basic and angle positions and locking the secondary half yard in its basic or angle positions. Alternatively, other type pivoting and/or locking means such as mechanical, hydraulic or electrical latching means, may be employed for pivoting and locking the secondary half yards in position.

In like manner upper and lower secondary half yards are pivotally mounted on each of the primary half yards. Thus, as can be seen in FIG. 1, secondary half yard pairs (64,66), (68,70), (72,74), (76,78) and (80,82) are pivotally mounted on primary half yards 28, 46, 48, 50 and 52, respectively, by pivot pins 62. A generally rectangular sail 84 is carried between opposed and facing secondary half yard pairs. Thus, as shown in FIG. 1, rectangular sails 84 are mounted between opposed and facing secondary half yard pairs (58,70), (64,74), (60,76) and (66,80). It will be apparent that each mast may carry as many primary and secondary half yards as may be desirable for the purpose of the sailboat and that sails may be carried between each pair of opposing and facing secondary half yards. It will also be apparent that the traditional "square" sail of the basic square rigged sailboat actually consists, in the embodiment shown, of two separate rectangular sails, one on each side of the mast. Such a sail configuration is believed by some to be more advantageous than a single "square" sail. Preferably, each of the rectangular sails is mounted on the secondary half yards by insertion in tracks (not shown) fixed on each of the secondary half yards and moves horizontally away from and toward the mast for setting and furling. In a particularly preferred form, roller reefing housings 86 may be mounted adjacent mast 14 between opposed and facing secondary half yard pairs to permit furling of the rectangular sails by conventional roller reefing. It will, of course, be appreciated that since the uppermost and lowermost primary half yards on each mast only mount sails below and above the primary half yards, respectively, each of the uppermost and lowermost primary half yards on each mast need have only a single secondary half yard pivotally mounted thereto.

Figure 5:
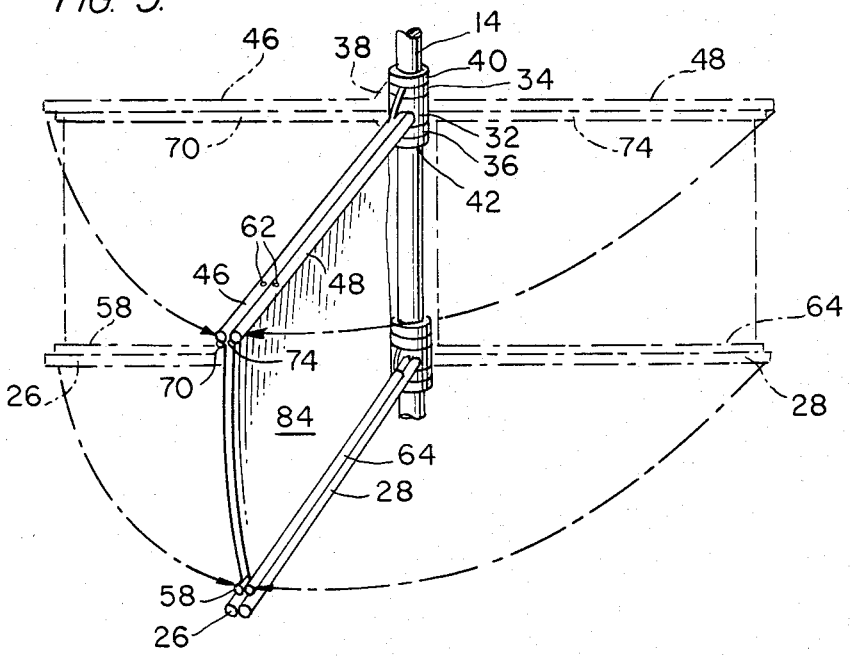
FIG. 5 is a partial perspective view of the sailboat of the present invention showing the sails arranged in a first fore-and-aft rigged configuration.
Figure 6:
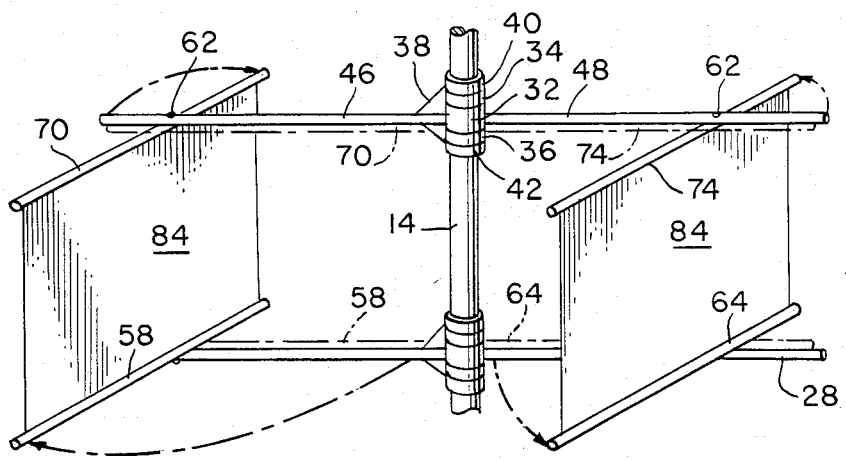
FIG. 6 is a partial perspective view of the sailboat of the present invention showing the sails arranged in a second fore-and-aft rigged configuration.

According to the present invention, the sail plan may be converted from square rigged, as shown in FIG. 1, to fore-and-aft rigged, as shown in FIGS. 5 and 6, and vice versa, in a simple, convenient manner which can be readily understood from a consideration of FIGS. 1–6. For purposes of description, it is assumed that the sailboat is initially in a square-rigged configuration as illustrated in FIG. 4*a* with the mast, sails and yards arranged as shown in FIG. 1. In this configuration, as can be seen in FIGS. 1 and 2*a*, the primary half yards, in a first position, extend from mast 14 in opposite directions to define between each pair of primary half yards (46,48), (26,28), (50,52) an angle of about 180°. The members of each pair of primary half yards are desirably locked in this configuration by suitable locking means in order that they may function together in the manner of the traditional, integral, rigid yard of a conventional square rigger mounted athwartships across the mast. The secondary half yards overlie and underlie and are coextensive with the primary half yards (in their basic or nominal position) as can be seen from FIGS. 1 and 3. When it is desired to convert the square-rigged sail plan to a fore-and-aft rigged configuration, as shown in FIGS. 4*b* and 5 (schooner rigged), according to a first conversion procedure, the locking means holding the primary half yards athwartships in the first position is released, allowing each of the primary half yards to pivot about mast 14 in a direction such that the outboard ends of the primary half yards are directed generally aft toward the stern of the sailboat, such as is illustrated in FIGS. 2*b* and 5, until the members of each pair of primary half yards reach the second position wherein they define an angle of essentially 0° therebetween. Locking means (not shown) are employed to retain the primary half yards in this doubled "boom" (or "gaff") second position. The rectangular sails which were on opposite sides of the mast in the square-rigged configuration now are adjacent and parallel, forming a double thickness, rectangular fore-and-aft sail having half the effective sail area of the original square-rigged configuration. If desired, the double thickness sail can be reduced to a single thickness sail by furling one or the other of the adjacent rectangular sails.

This first conversion from the square rigged configuration of FIGS. 1 and 4*a* to the fore-and-aft schooner rigged configuration of FIGS. 4*b* and 5 serves two functions: it converts the rig to a fore-and-aft rig when the sailboat must go to windward against a strong head wind; and, it is a sail shortening measure in heavy weather. To convert back to the square-rigged configuration of FIGS. 1 and 4*a* requires unlocking the primary half yards and pivoting them about mast 14 until the members of each pair once again extend athwartships in opposite directions from mast 14 and are locked in position to define a 180° angle therebetween and resetting any sails which might have been furled.

According to a second conversion procedure the sails may be converted from a square-rigged configuration, as shown in FIGS. 1 and 4*a*, to a fore-and-aft rigged configuration, as shown in FIGS. 4*c* and 6. The locking-means holding the primary half yards athwartships remains locked and the primary half yards remain in their first position, defining an angle of about 180° between members of each pair. The locking means holding the secondary half yards in their basic position, overlying and underlying and coextensive with the primary half yards, is released and the opposed, vertically spaced sail carrying secondary half yard pairs are caused to pivot about pivot pins 62 to an angle position until sails 84 assume a fore-and-aft position to produce twin, parallel sets of fore-and-aft sails, one on each side of the mast as shown in FIGS. 4*c* and 6. In this angle position, the secondary half yards form an angle greater than 0° and less than 180° with the primary half yards on which they are mounted. The secondary half yards are pivoted in a direction such that the ends thereof adjacent the mast in the basic position are directed generally aft toward the stern of the sailboat, such as is illustrated in FIG. 6 and in phantom in FIG. 3. This second conversion procedure is particularly suitable for dealing with light head winds since the conversion to fore-and-aft rig is effected without a reduction in sail area. To convert back to the square-rigged configuration of FIGS. 1 and 4*a* requires pivoting the secondary half yards about pivot pins 62 to swing them back to their basic or nominal position wherein they overlie and underlie and are coextensive with the primary half yards. To assure that in returning to the square-rigged configuration, the secondary half yards do not overshoot their basic or nominal position, it is desirable to provide stop means, such as flange means (not shown) extending above and below the primary half yards along the length of the primary half yards between the mast 14 and pivot pins 62. These flange means may be positioned along or adjacent the forward face of the primary half yards and may taper along their length from the mast towards the pivot pins.

The specific hardware and mechanisms employed in accordance with the present invention to accomplish the locking, releasing, pivoting, furling, setting and other procedures described herein are either well known and readily available or easily adaptable from well known and available hardware and mechanisms. Depending upon the intended usage of the sailboat, e.g., commercial vs. pleasure, and the financial investment to be made therein, the operating mechanisms and elements may be manually, mechanically, hydraulically or electrically actuated and the rig conversion and other operations may be automated and/or remotely controlled to the extent desired. In addition, running rigging and operating mechanisms are desirably concealed to the extent possible in hollow spars to reduce windage, one of the principal drawbacks of the traditional cargo-carrying square rigger.

INDUSTRIAL APPLICABILITY

The sail plan of the present invention is broadly applicable for converting the traditional square rig of exclusively wind driven cargo-carrying sailing ships, auxiliary powered commercial sailing ships and, on a reduced scale, even yachts, to fore-and-aft rig whenever the vessel has to deal with a foul wind in order that the clear advantages of the fore-and-aft rig become available under such conditions. Conversely, the fore-and-aft arrangement of sails need never be used for other than sailing to windward, for as soon as the wind is fair the sails may be converted back to the more effective square rig. Thus, each sail configuration can be used exclusively under the most favorable conditions for that type of rig. Moreover, the conversion to fore-and-aft rig can be carried out in two ways, depending on whether the vessel must sail against strong or light head winds, with combinations of both methods possible for intermediate wind conditions.

Figure 7A:
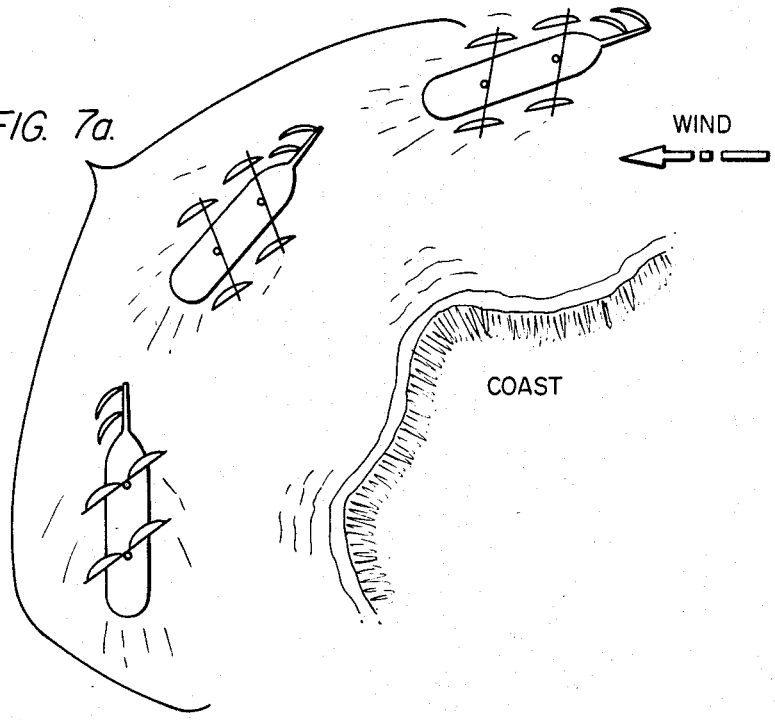
FIG. 7*a* is a plan view of the sailboat of the present invention carrying square-rigged and fore-and-aft rigged sail configurations as it proceeds around a coastal point in light wind conditions.
Figure 7B:
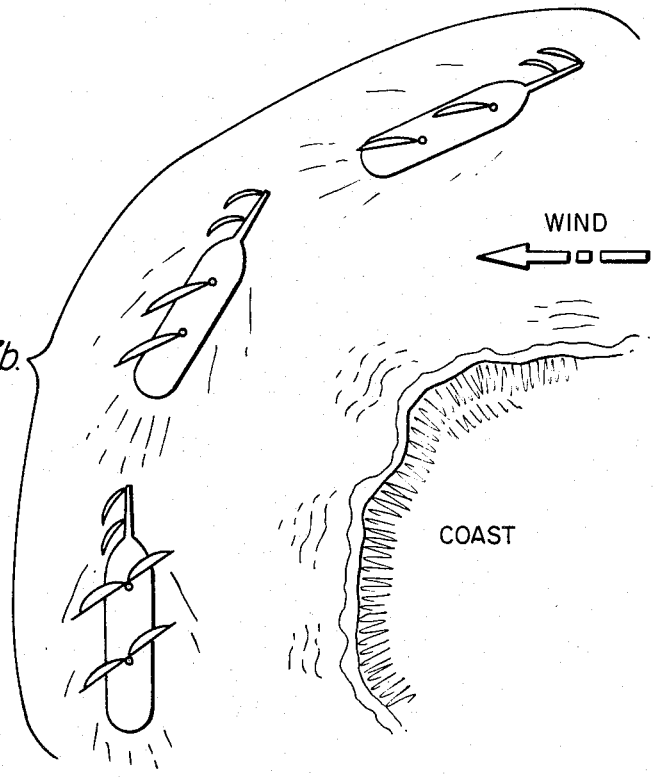
FIG. 7*b* is a plan view of the sailboat of the present invention carrying square-rigged and fore-and-aft rigged sail configurations as it proceeds around a coastal point in strong wind conditions.

It is contemplated that in operation the sail plan of the present invention will also allow the effective changeover from one type of rig to the other in a smooth, continuous operation involving a gradual transition accomplished by simultaneously swinging the yards between the square rig and fore-and-aft rig configurations and trimming the angle of the yards to take maximum advantage of the angle of the wind. Thus, as can be seen in FIG. 7*a* if a vessel were to sail square-rigged along a coast on a broad reach and then had to round a point to proceed on a windward course roughly at right angles to the course followed up the coast it is possible to start gradually "fore-and-afting" the secondary half yards and simultaneously pivoting the primary half yards, locked in their first position, about the mast in such a way that by a series of almost imperceptible changes a conversion from square rig to fore-and-aft rig is effected without running the risk of backing the square sails. In this operation the primary and secondary half yards would be trimmed for opposite tacks, i.e., if the secondary half yards are to be trimmed for the starboard tack, the primary half yards would be swung out to the port tack, and vice versa. Another advantage of this maneuver is that it allows a better entry for the wind to the after masts and their sails. Better entry of the wind to the sails might also be achieved, under these conditions, by furling some of the sails on the weather side, leaving a checkered sail pattern. Likewise, in stronger winds, as shown in FIG. 7*b*, the conversion to the fore-and-aft configuration of FIGS. 4*b* and 5 can be completed while the angle between the primary half yards and the hull axis is adjusted to take maximum advantage of the angle of the wind.

Figure 8:
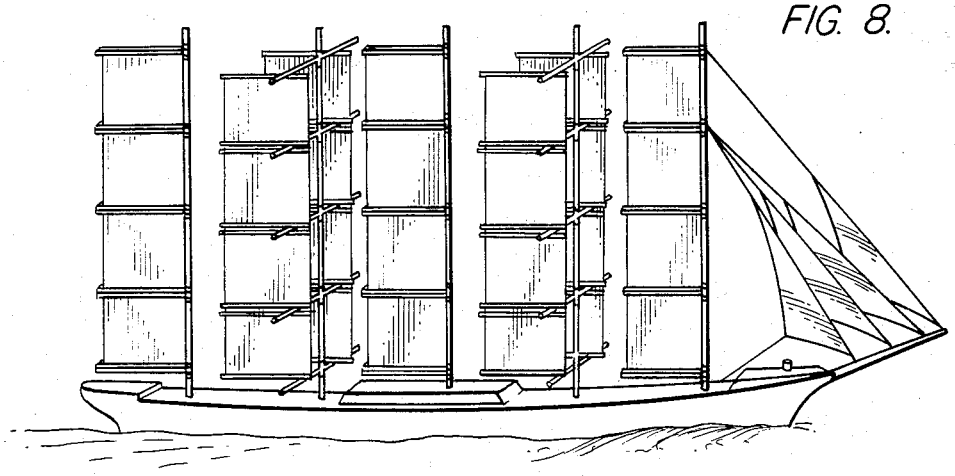
FIG. 8 is a perspective view of a multi-masted embodiment of the sailboat of the present invention showing the sails on some masts arranged as in FIG. 5 and on other masts arranged as in FIG. 6.
Figure 9:
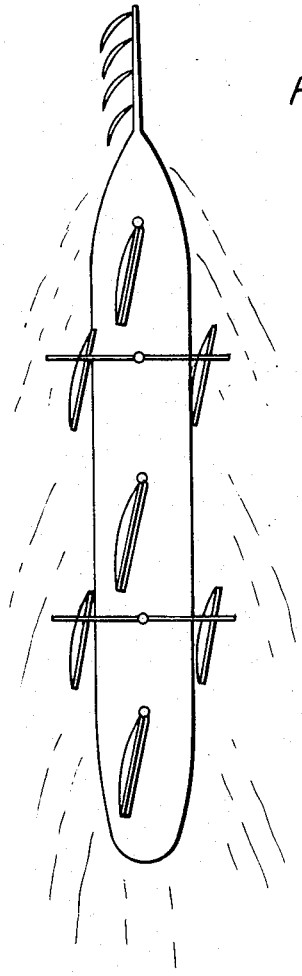
FIG. 9 is a plan view of the sailboat illustrated in FIG. 8.

Still another means for providing better entry for the wind which may be advantageous under some conditions is to convert a multi-masted vessel from a square-rigged to a fore-and-aft rigged configuration which simultaneously utilizes a combination of the fore-and-aft configurations of FIGS. 5 and 6. Thus, as shown in FIGS. 8 and 9, some masts are converted to schooner-rig (FIG. 5) while others are converted to twin sets of fore-and-aft sails (FIG. 6). This combination fore-and-aft sail configuration utilizing both schooner rigged masts and masts carrying twin sets of fore-and-aft sails is useful in dealing with head winds of intermediate strength and illustrates the extraordinary flexibility of the present invention. Moreover, these sailing vessls may be operated as any one of a considerable variety of recognizable types: as a square rigged or a fore-and-aft rigged ship of any number of masts; as a barkentine, by retaining the square rig only on the foremast, the remaining masts carrying fore-and-aft rigs of either the FIG. 5 or FIG. 6 type; as a multi-masted sailing vessel with the foremast square-rigged, the next mast schooner rigged, and so on alternatively; or as any number of mixed rig type sailing vessels.

It is claimed:

1. A sailboat comprising:

(a) at least one mast;

(b) first and second pairs of primary half yards pivotally mounted on said mast for pivoting substantially about the axis of said mast between a first position wherein the members of each pair of said primary half yards extend in opposite directions from the same axial location along said mast to define a 180° angle therebetween and a second position wherein the members of each pair of said primary half yards extend in substantially the same direction from the same axial location along said mast to define a substantially 0° angle therebetween, said second pair of primary half yards being vertically spaced from said first pair of primary half yards along said mast;

(c) means for moving said primary half yards between the first and second positions, said sailboat being convertible between square-rigged when said primary half yards are in said first position and fore-and-aft rigged when said primary half yards are in said second position; and (d) means for mounting a sail between vertically spaced apart members of each pair of primary half yards, said means for mounting a sail comprising a secondary half yard pivotally mounted on each primary half yard for pivotal movement about a pivot axis extending substantially parallel to said mast, said secondary half yards mounted on said first pair of primary half yards oppositely facing and spaced from said secondary half yards mounted on said second pair of primary half yards, each pair of vertically spaced opposed secondary half yards comprising sail mounting means for mounting a sail therebetween, said sail being pivotable with said pair of sail mounting secondary half yards between a basic position wherein said secondary half yards extend substantially coextensively with said primary half yards on which they are mounted and an angle position wherein each said pair of sail mounting secondary half yards is arranged at an angle greater than 0° and less than 180° to said primary half yards on which they are mounted, said sailboat being convertible between square rigged when said secondary half yards are in said basic position and said primary half yards are in said first position and fore-and-aft rigged when either said secondary half yards are in said basic position and said primary half yards are in said second position or said secondary half yards are in said angle position with said sails oriented substantially fore-and-aft and said primary half yards are in said first position.

2. A sailboat, as claimed in claim 1, further including:

a plurality of pairs of primary half yards pivotally mounted on and vertically spaced apart along said mast for pivoting substantially about the axis of said mast between said first and second positions; and a secondary half yard pivotally mounted on and above each of the lowermost primary half yards and on and below each of the uppermost primary half yards on said mast and secondary half yards pivotally mounted on, above and below, each other primary half yard on said mast.

3. A sailboat, as claimed in claim 2, further including means for releasably locking said primary half yards in said first and second positions and said secondary half yards in said basic and angle positions.

4. A sailboat, as claimed in claim 1, further including means for releasably locking said primary half yards in said first and second positions and said secondary half yards in said basic and angle positions.

5. A sailboat, as claimed in claims 1, 2, 4 or 3, further including means pivotally mounting each said pair of primary half yards on said mast for permitting only 180° pivoting of each member of each said pair relative to the other member of each said pair.

6. A sailboat, as claimed in claim 5, further including stop means preventing greater than 180° pivoting of each member of each said pair relative to the other member of each said pair.

7. A sailboat, as claimed in claim 6, wherein each said primary half yard is pivotally mounted on said mast at its end adjacent said mast.

8. A sailboat, as claimed in claims 1, 2, 4 or 3, wherein said pivot axis comprises a pivot pin extending through said primary half yard and each said secondary half yard mounted thereon.

9. A sailboat, as claimed in claim 8, wherein said pivot pin extends through said primary half yard at a point along the length thereof located between its middle and the end thereof remote from said mast.

10. A sailboat, as claimed in claim 9, wherein said pivot pin extends through said primary half yard at a point about two-thirds of its length from said mast.

* * * * *